US008690532B2

(12) United States Patent
Iwai et al.

(10) Patent No.: US 8,690,532 B2
(45) Date of Patent: Apr. 8, 2014

(54) NOZZLE BOX OF AXIAL FLOW TURBINE AND AXIAL FLOW TURBINE

(75) Inventors: Yasunori Iwai, Yokohama (JP); Tsutomu Ooishi, Yokohama (JP); Yoshiki Niizeki, Tokyo (JP); Taro Kawabata, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1073 days.

(21) Appl. No.: 12/714,948

(22) Filed: Mar. 1, 2010

(65) Prior Publication Data

US 2010/0232958 A1 Sep. 16, 2010

(30) Foreign Application Priority Data

Mar. 13, 2009 (JP) ..... 2009-062048

(51) Int. Cl.
*F01D 9/02* (2006.01)

(52) U.S. Cl.
USPC ..... 415/212.1; 415/222

(58) Field of Classification Search
USPC ..... 415/212.1, 218.1, 219.1, 222, 205
See application file for complete search history.

(56) References Cited

U.S. PATENT DOCUMENTS

| | | | |
|---|---|---|---|
| 2,526,281 | A | 10/1950 | Ryan et al. |
| 2,527,446 | A | 10/1950 | Jenks et al. |
| 3,371,480 | A | 3/1968 | Page et al. |
| 6,631,858 | B1 | 10/2003 | Farineau et al. |
| 2008/0056891 | A1 | 3/2008 | Hamlin et al. |

FOREIGN PATENT DOCUMENTS

| | | | |
|---|---|---|---|
| BE | 456 294 | A | 7/1944 |
| JP | 60-069212 | A | 4/1985 |
| JP | 2008-038741 | A | 2/2008 |
| JP | 2008/064091 | A | 3/2008 |

*Primary Examiner* — Edward Look
*Assistant Examiner* — Maxime Adjagbe
(74) *Attorney, Agent, or Firm* — Foley & Lardner LLP

(57) ABSTRACT

A nozzle box 10 includes: a lead-in pipe 20; a bent pipe 30 connected to the lead-in pipe 20 and formed so as to change a direction of a channel center line 50 to an axial direction of a turbine rotor 212; and an annular pipe 40 connected to the bent pipe 30 and leading steam to a first-stage nozzle 213*a* while spreading the steam in a circumferential direction of the turbine rotor 212. In the steam channel lead-in part structure 10, from an inlet of the lead-in pipe 20 toward an outlet of the annular pipe 40, steam channel widths Sa-1 to Sn-1 in a first direction intersecting with the channel center line 50 gradually increases and steam channel widths Sa-2 to Sn-2 in a second direction intersecting with the channel center line 50 and perpendicular to the first direction gradually decreases.

8 Claims, 10 Drawing Sheets

NOZZLE BOX OF AXIAL FLOW TURBINE AND AXIAL FLOW TURBINE

CROSS-REFERENCE TO RELATED APPLICATIONS

This application is based upon and claims the benefit of priority from the prior Japanese Patent Application No. 2009-062048, filed on Mar. 13, 2009; the entire contents of which are incorporated herein by reference.

BACKGROUND OF THE INVENTION

1. Field of the Invention

The present invention relates to a nozzle box that constitutes a channel of a working fluid leading the working fluid to a first-stage nozzle of an axial flow turbine, and to an axial flow turbine including the nozzle box.

2. Description of the Related Art

An axial flow rotary machine such as a steam turbine used in a thermal power station and the like includes blade cascades composed of a plurality of stages of the combination of a nozzle whose channel for the passage of a working fluid is stationary and a rotor blade which rotates. A steam turbine is generally divided into a high-pressure part, an intermediate-pressure part, and a low-pressure part depending on a condition of steam being a working fluid. In order to improve efficiency of the work by the working fluid in each blade cascade part, channels between the blade cascades have to be designed in a shape allowing smooth flow of the working fluid.

Conventionally, in power generating machines, efficiency improvement of the machines has been an important task in order to realize effective use of energy resources and reduction in CO emission. An example of a measure to improve efficiency of a steam turbine is to effectively convert given energy to mechanical work. One measure for this is to reduce various internal losses.

The internal losses in a steam turbine blade cascade of a steam turbine include a profile loss ascribable to the shape of blades, a secondary loss ascribable to a secondary flow, a leakage loss ascribable to leakage of a working fluid to the outside of a blade cascade, and a moisture loss ascribable to drain, which is unique to a final blade group. The internal losses further include a loss in a steam valve, a passage part leading steam to some blade cascade, and a passage part from some blade cascade up to the next blade cascade, an exhaust loss in a low-pressure final stage, and so on.

For example, JP-A 2008-38741 (KOKAI) discloses an art to uniformly lead a working fluid to a blade cascade in order to reduce a pressure loss in a passage part connecting some blade cascade and another blade cascade. According to this art, in order to uniformly lead the working fluid to a blade cascade of an axial flow turbine, the width of the passage part through which the working fluid passes is monotonously increased toward a downstream side.

Here, the structure of a conventional nozzle box 300, which is a working fluid (e.g. steam) inlet of an axial flow turbine, will be described. FIG. 9 is a perspective view showing part of the conventional nozzle box 300. FIG. 10 is a view showing the conventional nozzle box 300 in its cross section vertical to a turbine rotor seen from a first-stage nozzle 303 side. FIG. 11 is a view showing a cross section of the conventional nozzle box 300 taken along a channel center line. The illustration of the turbine rotor, which is penetratingly provided at the center of the nozzle box 300, is omitted here.

For example, as shown in FIG. 9, the nozzle box 300 is a structure forming a steam channel through which steam led into lead-in pipes 302 passes to be led into a first-stage nozzle 303.

As shown in FIG. 10, the nozzle box 300 is separated into two upper and lower spaces, and steam 301 from a boiler (not shown) is led into each of the spaces through the two lead-in pipes 302.

As shown in FIG. 10, the steam 301 led into the lead-in pipes 302 made of a cylindrical pipe is led to the first-stage nozzle 303 through an annular channel 304. On a downstream side of the first-stage nozzle 303, the whole periphery of the passage part is coupled, and the steam 301 having passed through the first-stage nozzle 303 is led to a first-stage rotor blade (not shown).

Here, Sa-1 to Sn-1 shown in FIG. 10 each are a steam channel width in a first direction intersecting with a channel center line 305 at a predetermined position of a steam channel formed by the nozzle box 300. Sa-2 to Sn-2 shown in FIG. 11 each are a steam channel width in a second direction intersecting with the channel center line 305 and perpendicular to the first direction. The steam channel width in the first direction and the steam channel width in the second direction exist on the same channel cross section perpendicularly intersecting with the channel center line 305 of the steam channel. Further, when the seam channel width in the first direction and the steam channel width in the second direction are different from each other, the steam channel width in the first direction is a steam channel width in a longitudinal direction on the channel cross section. That is, the steam channel width in the first direction is the largest channel width on this channel cross section.

As shown in FIG. 9, for example, at an inlet portion of the nozzle box 300, a cross sectional shape of the steam channel is circular. Therefore, the steam channel width in the first direction and the steam channel width in the second direction are equal to each other. Here, a steam channel width in a direction corresponding to a steam channel width in the longitudinal direction of a channel cross section which is on a downstream side of the cross section where the cross sectional shape of the steam channel is circular and thus the steam channel width in the first direction and the steam channel width in the second direction are different from each other, is set as Sa-1. Further, the steam channel width in the first direction intersecting with the channel center line 305 at an outlet of the nozzle box 300, that is, at an inlet of the first-stage nozzle 303 is shown as Sn-1, and the steam channel width in the second direction intersecting with the channel center line 305 and perpendicular to this first direction is shown as Sn-2.

In the conventional nozzle box 300, as shown in FIG. 10, the steam channel width Sa-1 and the steam channel width Sb-1 in each of the lead-in pipes 302 are equal to each other, but the steam channel width begins to widen from the steam channel width Sc-1 near a joint portion between the lead-in pipe 302 and the annular channel 304. The steam channel widths Sd-1, Se-1 in the annular channel 304 greatly widen further. Further, as shown in FIG. 11, the steam channel width Sa-2 to the steam channel width Sc-2 in the lead-in pipe 302 are equal to one another, but the steam channel width gets gradually narrower from the steam channel width Sd-2. Then, the steam channel width Sn-2 at the inlet of the first-stage nozzle 303 is equal to the height of the first-stage nozzle 303.

FIG. 12 is a graph showing area ratios equal to areas of channel cross sections Sa to Sn which include the steam channel widths Sa-1 to Sn-1, Sa-2 to Sn-2 shown in FIG. 10 and FIG. 11 and perpendicularly intersect with the channel center line 305 of the steam channel, divided by an area of the channel cross section Sa which is at the inlet of the lead-in pipe and which includes the steam channel widths Sa-1 and the steam channel width Sa-2 and perpendicularly intersects with the channel center line 305 of the steam channel. Note that FIG. 12 also shows area ratios in channel cross sections other than the channel cross sections Sa to Sn.

As shown in FIG. 12, the area ratios of the channel cross sections up to a channel cross section slightly on an upstream side of the channel cross section Sc have a constant value of 1 since they are channel cross sections of the aforesaid lead-in pipe 302. In the channel cross sections on a downstream side of the channel cross section slightly on the upstream side of the channel cross section Sc, the area ratio abruptly increases. The area ratio presents a peak in the channel cross section Sd, and the area ratio abruptly decreases in the channel cross section on a downstream side of the channel cross section Sd.

FIG. 13 is a graph showing a total pressure loss ratio in each of the channel cross sections shown in FIG. 12. Here, the total pressure loss ratio is expressed by the following expression (1), where Pa is a total pressure in the channel cross section Sa at the inlet of the steam channel formed by the nozzle box 300 and Po is a total pressure in a given channel cross section.

$$\text{total pressure loss ratio (\%)}=(Pa-Po)/Pa\times 100 \qquad \text{Expression (1)}$$

Note that the above total pressure loss ratios are obtained by three-dimensional thermal-fluid analysis in a steady state by using a CFD (Computational Fluid Dynamics).

As shown in FIG. 13, the total pressure loss ratio abruptly increases from the channel cross section slightly on the upstream side of the channel cross section Sc. This is a pressure loss that occurs because, from the channel cross section slightly on the upstream side of the channel cross section Sc, the steam channel width abruptly increases and thus the area ratio abruptly increases as shown in FIG. 12.

As described above, the conventional nozzle box 300 in the axial flow turbine has the problem that the abrupt increase in the area ratio due to the abrupt increase in the steam channel width causes a great pressure loss. This lowers turbine efficiency of the axial flow turbine and thus makes it difficult to obtain high turbine efficiency.

BRIEF SUMMARY OF THE INVENTION

Therefore, it is an object of the present invention to provide a nozzle box of an axial flow turbine which can realize a reduction in a pressure loss in a steam channel and thus can achieve improved turbine efficiency and to an axial flow turbine including the nozzle box.

According to one aspect of the present invention, there is provided a nozzle box of an axial flow turbine, which forms a working fluid channel leading a working fluid to a first-stage nozzle of the axial flow turbine, the nozzle box including: a lead-in pipe into which the working fluid is led; a bent pipe connected to the lead-in pipe and formed so as to change a direction of a channel center line to an axial direction of a turbine rotor of the axial flow turbine; and an annular pipe connected to the bent pipe, covering the turbine rotor from an outer peripheral side of the turbine rotor, and forming an annular passage leading the working fluid to the first-stage nozzle while spreading the working fluid in a circumferential direction of the turbine rotor, wherein, in the working fluid channel composed of the lead-in pipe, the bent pipe, and the annular pipe, from an inlet of the lead-in pipe toward an outlet of the annular pipe, a channel width in a first direction intersecting with the channel center line gradually increases and a channel width in a second direction intersecting with the channel center line and perpendicular to the first direction gradually decreases.

According to another aspect of the present invention, there is provided an axial flow turbine in which a led-in working fluid is led to a first-stage nozzle via a working fluid channel, wherein the working fluid channel is composed of the above-described nozzle box of the axial flow turbine.

BRIEF DESCRIPTION OF THE DRAWINGS

The present invention will be described with reference to the drawings, but these drawings are provided only for an illustrative purpose and in no respect, are intended to limit the present invention.

DETAILED DESCRIPTION OF THE INVENTION

Hereinafter, an embodiment of the present invention will be described with reference to the drawings.

Figure 1:
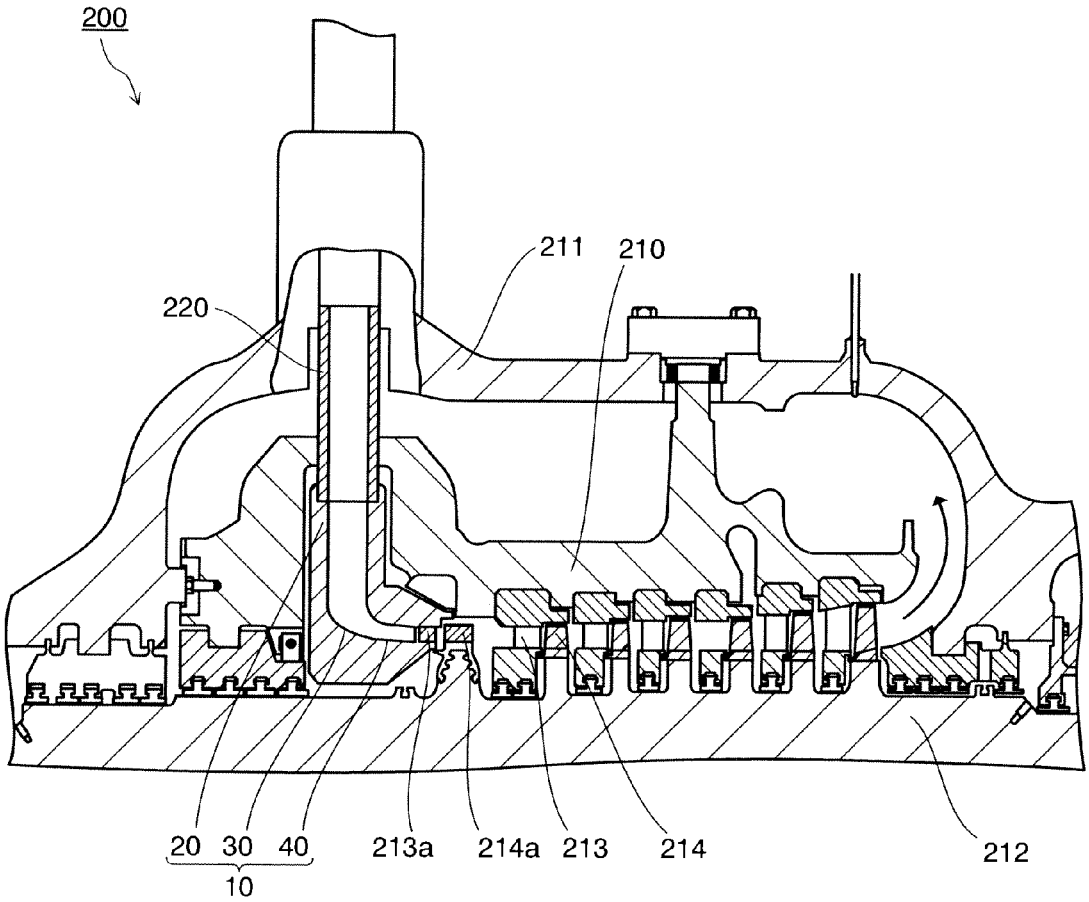
FIG. 1 is a view showing a cross section in an upper half casing part of a steam turbine including a nozzle box according to the present invention.

FIG. 1 is a view showing a cross section in an upper half casing part of a steam turbine 200 including a nozzle box 10 according to the present invention.

As shown in FIG. 1, the steam turbine 200 functioning as an axial flow turbine includes, for example, a double-structure casing composed of an inner casing 210 and an outer casing 211 provided outside the inner casing 210. Further, a turbine rotor 212 is penetratingly provided in the inner casing 210. Further, on an inner surface of the inner casing 210, nozzles 213 are disposed, and in the turbine rotor 212, rotor blades 214 are implanted.

The steam turbine 200 further includes the nozzle box 10. The nozzle box 10 is a steam channel leading steam, which is a working fluid led into the steam turbine 200, to a first-stage nozzle 213*a*. In other words, the nozzle box 10 constitutes a steam inlet of the steam turbine 200. The nozzle box 10 includes: a lead-in pipe 20 provided at an end portion of a steam inlet pipe 220 which is provided to penetrate through the outer casing 211 and the inner casing 210; a bent pipe 30 connected to the lead-in pipe 20 and formed so as to change a direction of a channel center line 50 to a direction along a center axis of the turbine rotor 212 of the steam turbine 200; and an annular pipe 40 connected to the bent pipe 30, covering the turbine rotor 212 from an outer peripheral side of the turbine rotor 212, and forming an annular passage leading the steam to the first-stage nozzle 213*a* while spreading the steam in a circumferential direction of the turbine rotor 212. The pipes forming the nozzle box 10 will be described in detail later.

The steam flowing into the steam channel formed by the nozzle box 10 passes through the lead-in pipe 20, the bent pipe 30, and the annular pipe 40 to be led to the first-stage nozzle 213*a*. The whole periphery of the passage part is coupled on a downstream side of the first-stage nozzle 213*a*, and the steam led to the first-stage nozzle 213*a* is ejected toward a first-stage rotor blade 214*a*. The ejected steam passes through steam passages between the nozzles 213 and the rotor blades 214 of respective stages to rotate the turbine rotor 212. Further, most of the steam having performed expansion work is discharged and passes through, for example, a low-temperature reheating pipe (not shown) to flow into a boiler (not shown). Further, part of the steam having performed the expansion work is led, for example, as cooling steam to an area between the inner casing 210 and the outer casing 211 to be discharged from a ground part or from a discharge route through which most of the steam having performed the expansion work is discharged.

It should be noted that the steam turbine 200 is not limited to that having the above-described structure, but it may be any steam turbine having the structure in which steam is led and the steam passes through steam passages between nozzles and rotor blades of respective stages to rotate a turbine rotor.

Next, the nozzle box 10 according to the present invention will be described.

Figure 2:
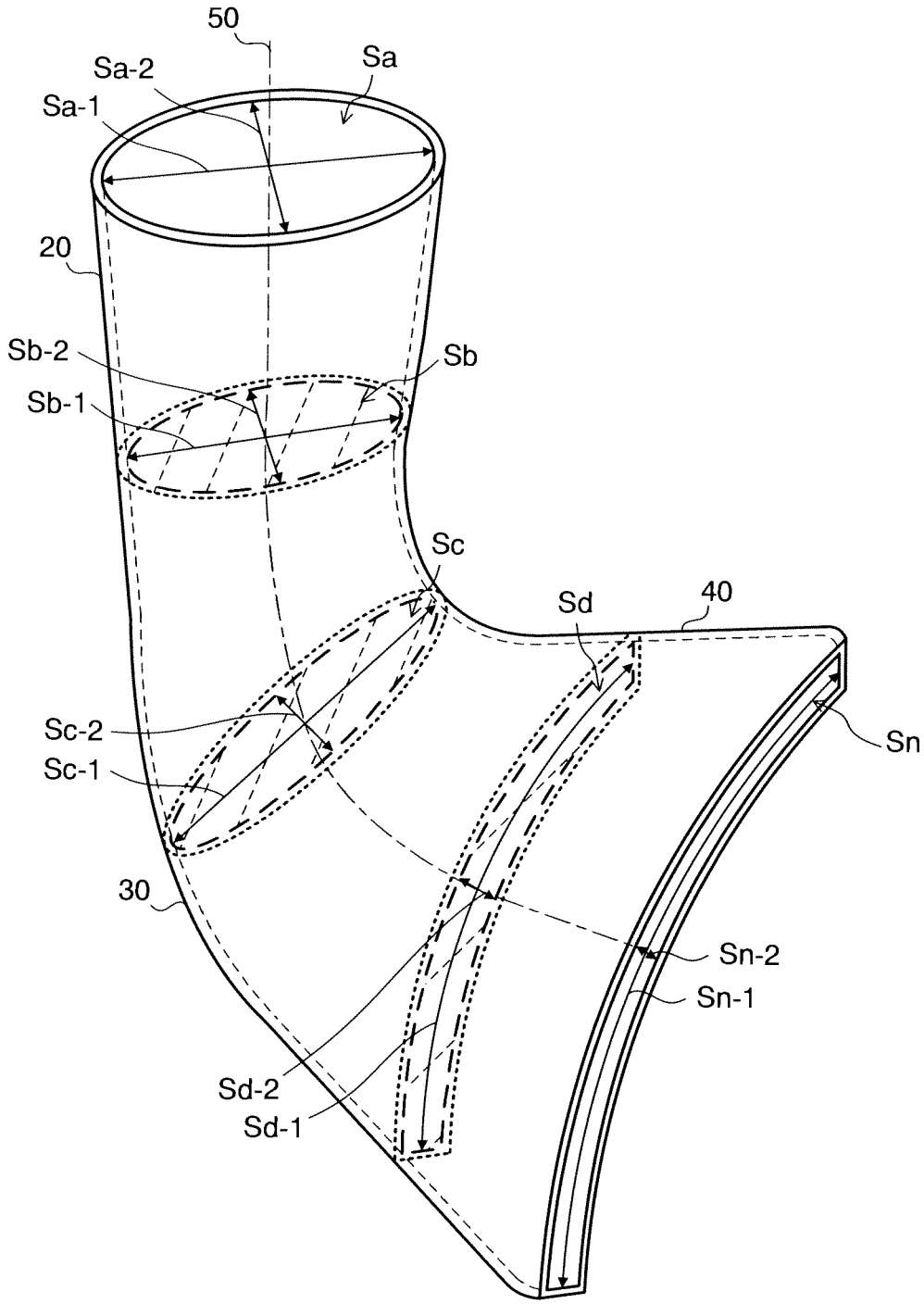
FIG. 2 is a perspective view showing part of the nozzle box of one embodiment according to the present invention.
Figure 3:
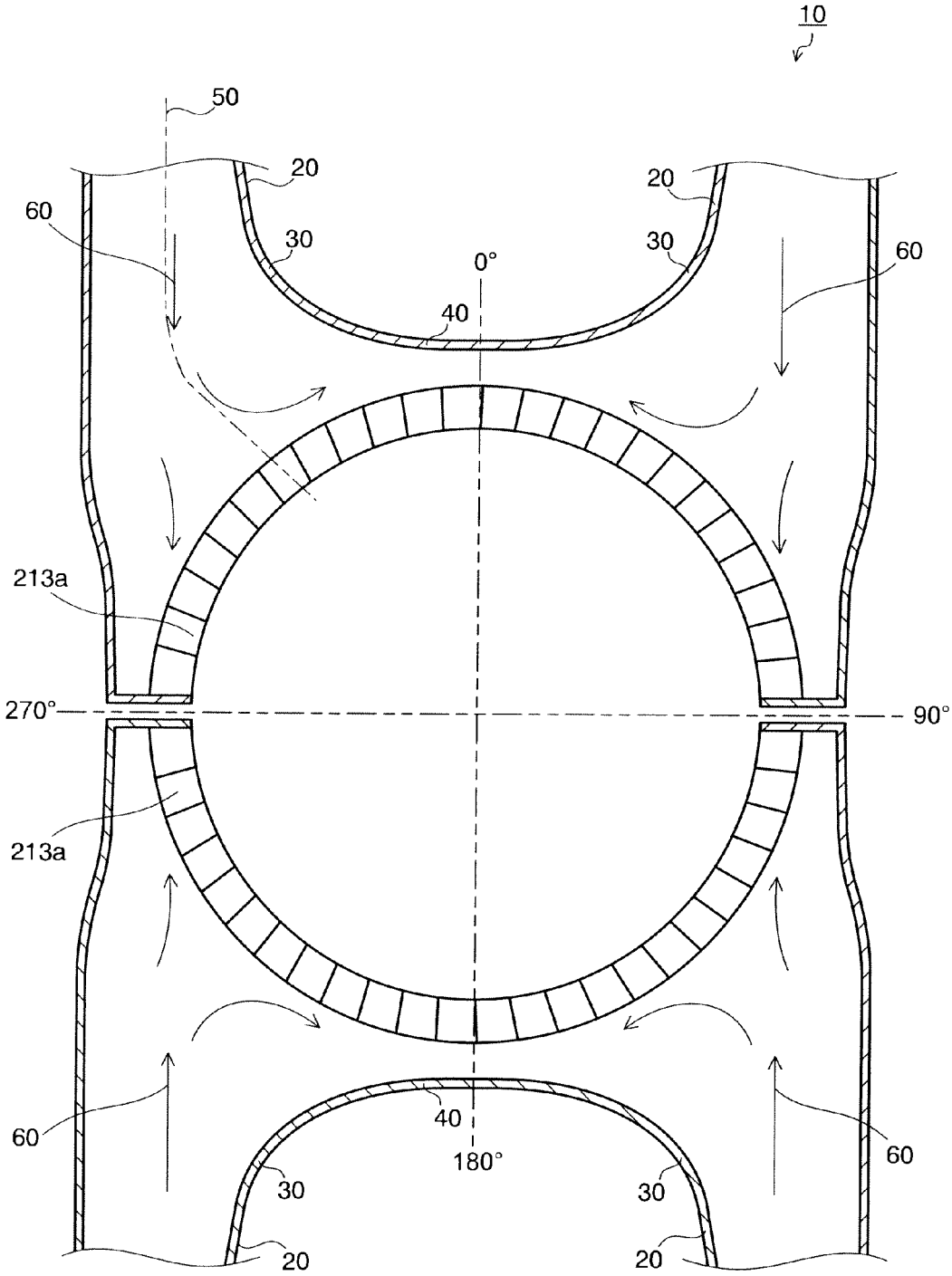
FIG. 3 is a view showing the nozzle box of the embodiment according to the present invention in its cross section vertical to a turbine rotor seen from a first-stage nozzle side.
Figure 4:
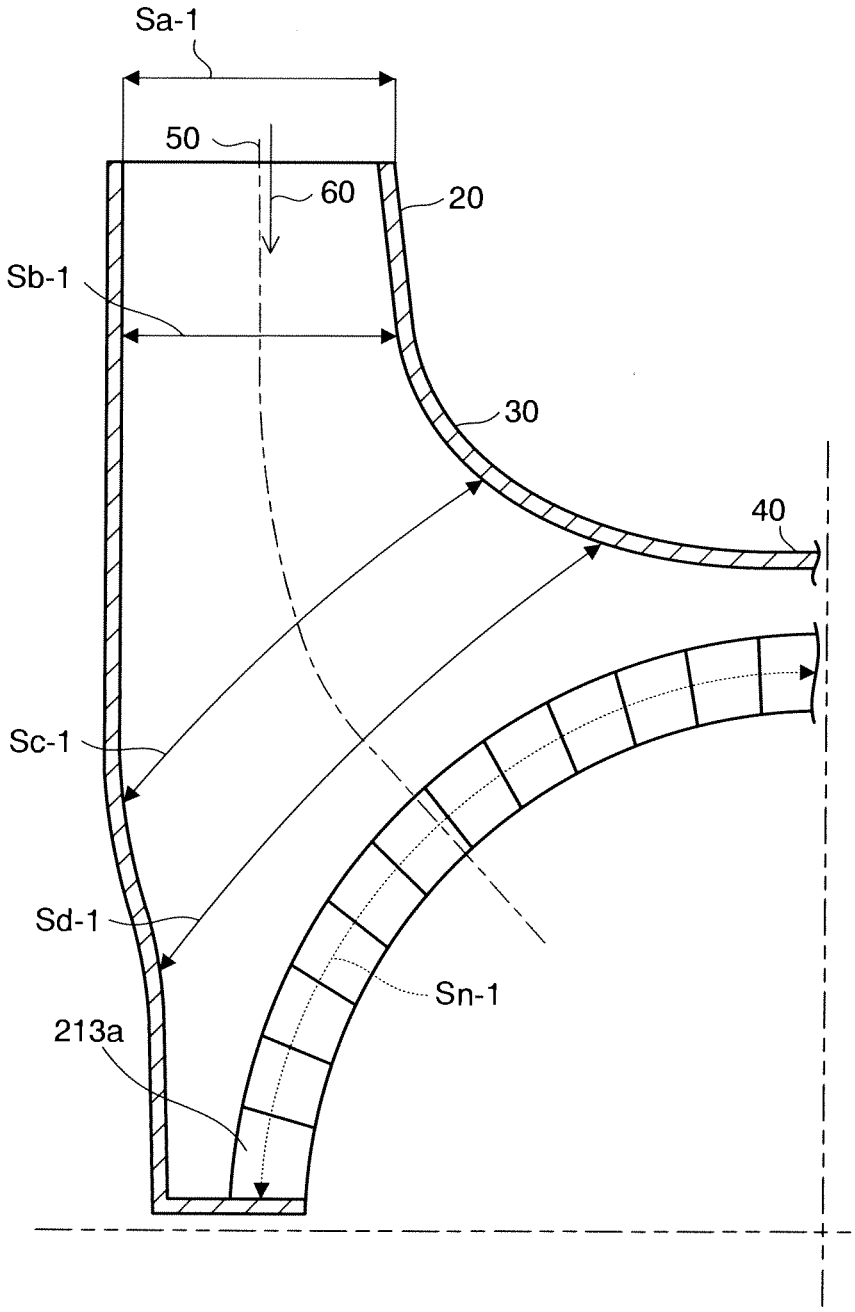
FIG. 4 is a partial enlarged view showing the nozzle box of the embodiment according to the present invention in its cross section vertical to the turbine rotor seen from the first-stage nozzle side.
Figure 5:
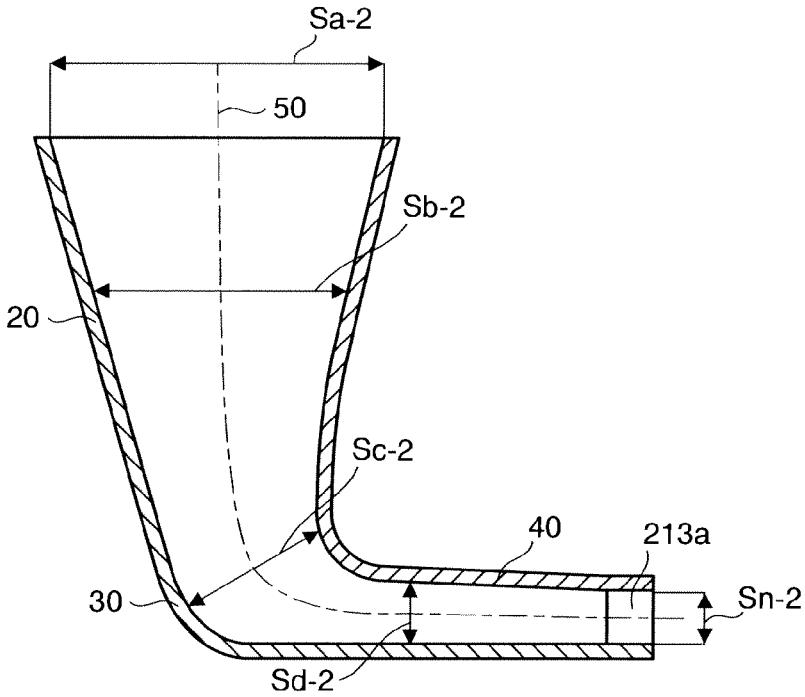
FIG. 5 is a view showing a cross section taken along a channel center line of the nozzle box of the embodiment according to the present invention.

FIG. 2 is a perspective view showing part of the nozzle box 10 of the embodiment according to the present invention. FIG. 3 is a view showing the nozzle box 10 of the embodiment according to the present invention in its cross section vertical to the turbine rotor 212 seen from the first-stage nozzle 213*a* side. FIG. 4 is a partial enlarged view showing the nozzle box 10 of the embodiment according to the present invention in its cross section vertical to the turbine rotor 212 seen from the first-stage nozzle 213*a* side. FIG. 5 is a view showing a cross section taken along the channel center line of the nozzle box 10 of the embodiment according to the present invention. Note that the illustration of the turbine rotor 212, which is penetratingly provided at the center of the nozzle box 10, is omitted in FIG. 2 to FIG. 5.

As shown in FIG. 2, the nozzle box 10 is a structure forming the steam channel through which the steam led into the lead-in pipe 20 passes to be led into the first-stage nozzle 213*a*. As shown in FIG. 3, the nozzle box 10 is divided into, for example, two upper and lower spaces. For the annular pipe 40 forming each of the spaces, two pairs of pipes into which the steam 60 from the boiler (not shown) is led are provided, each of the pairs being composed of a lead-in pipe 20 and a bent pipe 30.

The nozzle box 10 further includes: the lead-in pipe 20 provided at the end portion of the steam inlet pipe 220 and into which the steam is led; the bent pipe 30 connected to the lead-in pipe 20 and formed so as to change the direction of the channel center line 50 to the direction along the center axis of the turbine rotor 212 of the steam turbine 200; and the annular pipe 40 connected to the bent pipe 30, covering the turbine rotor 212 from the outer peripheral side of the turbine rotor 212, and forming the annular passage leading the steam to the first-stage nozzle 213*a* while spreading the steam in the circumferential direction of the turbine rotor 212.

Incidentally, the lead-in pipe 20 may be provided so as to be connected to the end portion of the steam inlet pipe 220, or the structure of the end portion of the steam inlet pipe 220 may be the structure as the lead-in pipe 20. In other words, the steam inlet pipe 220 and the lead-in pipe 20 can be integrally structured. Since the lead-in pipe 20 is formed in this manner, the lead-in pipe 20 forms the steam channel in an extending direction of the steam inlet pipe 220, in other words, in a direction perpendicular to a horizontal plane along the center axis of the turbine rotor 212.

Further, the bent pipe 30 may be any provided that it changes even slightly the aforesaid direction of the channel center line 50 extending from the lead-in pipe 20, which direction is perpendicular to the horizontal plane along the center axis of the turbine rotor 212, to the axial direction of the turbine rotor 212. That is, it is only necessary that at an outlet of the bent pipe 30, the direction of the channel center line 50 is changed to the axial direction of the turbine rotor 212. Here the change to the axial direction of the turbine rotor 212 does not necessarily mean that the direction of the channel center line 50 at the outlet of the bent pipe 30 is horizontal to the horizontal plane along the center axis of the turbine rotor 212 and is changed to the axial direction of the turbine rotor 212. For example, this change may also include a case where the direction of the channel center line 50 at the outlet of the bent pipe 30 has a predetermined angle to the horizontal surface along the center axis of the turbine rotor 212 and is changed to the axial direction of the turbine rotor 212.

As shown in FIG. 2 to FIG. 5, the steam channel formed by the lead-in pipe 20, the bent pipe 30, and the annular pipe 40 is formed such that, from the inlet of the lead-in pipe 20 toward the outlet of the annular pipe 40 (an inlet of the first-stage nozzle 213*a*), steam channel widths Sa-1 to Sn-1 in a first direction intersecting with the channel center line 50 gradually increases and steam channel widths Sa-2 to Sn-2 in a second direction which intersects with the channel center line 50 and is perpendicular to the first direction gradually decreases. Note that the steam channel width at the outlet of the annular pipe 40, that is, at the inlet of the first-stage nozzle 213*a*, in the first direction intersecting with the channel center line 50 is shown as Sn-1, and a steam channel width in the second direction intersecting with the channel center line 50 and perpendicular to this first direction is shown as Sn-2.

Further, the steam channel width Sn-2 at the outlet of the annular pipe 40 is equal to the height of the first-stage nozzle 213*a*.

Further, the steam channel widths Sa-1 to Sn-1 in the first direction and the steam channel widths Sa-2 to Sn-2 in the second direction exist on the same channel cross sections perpendicularly intersecting with the channel center line 50 of the steam channel, and when the steam channel width in the first direction and the steam channel width in the second direction are different from each other, the steam channel width in the first direction is a steam channel width in a longitudinal direction on this channel cross section. That is, the steam channel width in the first direction is the largest channel width on this channel cross section.

Figure 6:
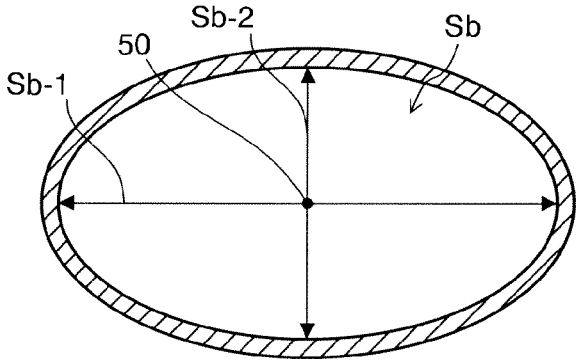
FIG. 6 is a view showing a channel cross section in which a steam channel width in a first direction and a steam channel width in a second direction are different from each other and which includes a steam channel width Sb-1 and a steam channel width Sb-2.

Here, FIG. 6 is a view showing a channel cross section where the steam channel width in the first direction and the steam channel width in the second direction are different from each other and which includes the steam channel width Sb-1 and the steam channel width Sb-2. As shown in FIG. 6, the steam channel width in the longitudinal direction intersecting with the channel center line 50 on the channel cross section is defined as the steam channel width Sb-1 in the first direction.

For example, at the inlet of the lead-in pipe 20, since the cross sectional shape of the steam channel is circular, the steam channel width in the first direction and the steam channel width in the second direction are equal to each other. Here, the steam channel width in a direction corresponding to the steam channel width in the longitudinal direction of a channel cross section which is on a downstream side of the cross section where the cross sectional shape of the steam channel is circular and thus the steam channel width in the first direction and the steam channel width in the second direction are different from each other, is set as Sa-1.

Further, as shown in FIG. 2, areas of the channel cross sections Sa to Sn including the steam channel widths Sa-1 to Sn-1 in the first direction and the steam channel widths Sa-2 to Sn-2 in the second direction respectively monotonously change from the inlet of the lead-in pipe 20 toward the outlet of the annular pipe 40. For example, the areas of the channel cross sections Sa to Sn including the steam channel widths Sa-1 to Sn-1 in the first direction and the steam channel widths Sa-2 to Sn-2 in the second direction respectively may monotonously decrease or may monotonously increase from the inlet of the lead-in pipe 20 toward the outlet of the annular pipe 40.

It is assumed that the steam channel width in the first direction at a position near the first-stage nozzle 213*a* represents a channel width in a ¼ range demarcated by center sectional lines of the nozzle box 10 which is vertically and laterally symmetrical, that is, demarcated by a center line connecting 0° and 180° and a center line connecting 90° and 270° in FIG. 3.

Figure 7:
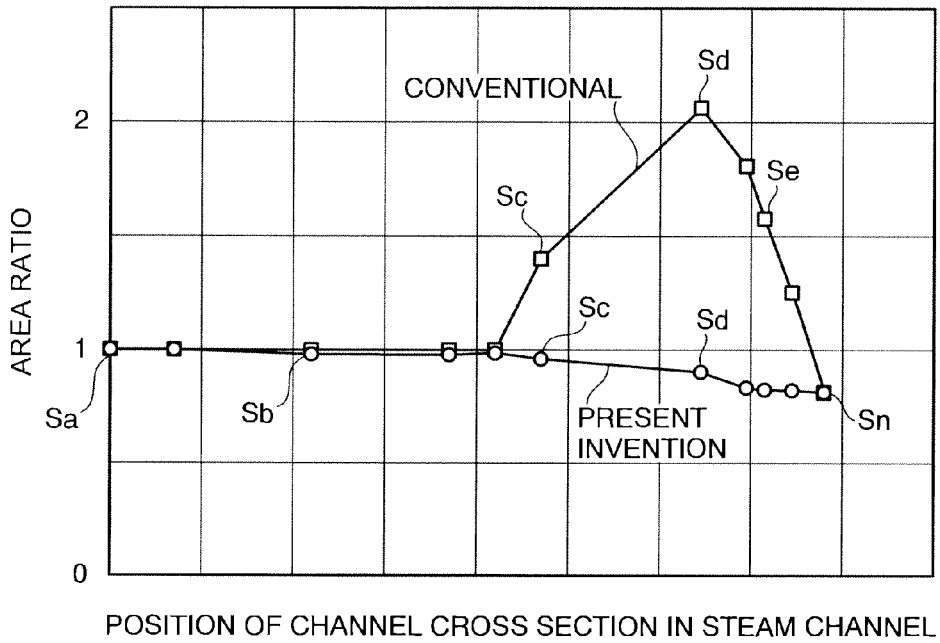
FIG. 7 is a graph showing area ratios equal to areas of channel cross sections Sa to Sn which include steam channel widths Sa-1 to Sn-1, Sa-2 to Sn-2 shown in FIG. 2 to FIG. 5 and perpendicularly intersect with the channel center line of a steam channel, divided by an area of a channel cross section Sa which is at an inlet of a lead-in pipe and which includes the steam channel width Sa-1 and the steam channel width Sa-2 and perpendicularly intersects with the channel center line of the steam channel.
Figure 12:
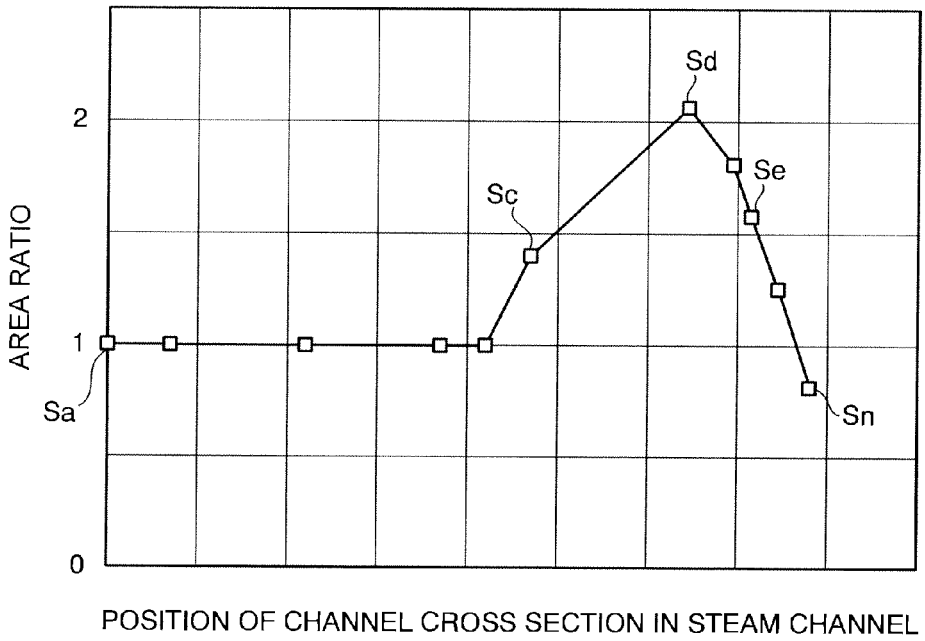
FIG. 12 is a graph showing area ratios equal to areas of channel cross sections So to Sn which include steam channel widths Sa-1 to Sn-1, Sa-2 to Sn-2 shown in FIG. 10 and FIG. 11 and perpendicularly intersect with the channel center line of a steam channel, divided by an area of a channel cross section Sa which is at an inlet of a lead-in pipe and which includes the steam channel width Sa-1 and the steam channel width Sa-2 and perpendicularly intersects with the channel center line of the steam channel.

FIG. 7 is an example of a graph showing area ratios equal to areas of the channel cross sections Sa to Sn which include the steam channel widths Sa-1 to Sn-1, Sa-2 to Sn-2 shown in FIG. 2 to FIG. 5 and perpendicularly intersect with the channel center line 50 of the steam channel, divided by an area of the channel cross section Sa which is at the inlet of the lead-in pipe 20 and which includes the steam channel width Sa-1 and the steam channel width Sa-2 and perpendicularly intersects with the channel center line 50. Note that FIG. 7 also shows area ratios in channel cross sections other than the area ratios in the channel cross sections Sa to Sn. Further, FIG. 7 also shows, for comparison, area ratios in the conventional nozzle box 300 shown in FIG. 12. Further, positions of the channel cross sections Se to Sn in the steam channel, that is, lengths along the channel center line 50 from the inlet of the nozzle box 10 up to the channel cross sections Sa to Sn in the nozzle box 10 of the embodiment correspond to those in the conventional nozzle box 300.

In the example of the present invention in FIG. 7, the area ratio monotonously decreases from the inlet of the lead-in pipe 20 toward the outlet of the annular pipe 40. Further, it is seen that the change in the area ratio in the nozzle box 10 of the embodiment is a monotonous change compared with the change in the area ratio in the conventional nozzle box 300. The channel cross section Sa and the channel cross section Sn are determined by a design condition of the steam turbine, and it sometimes depends on the type of the steam turbine whether a ratio of the area of the channel cross section Sn and the area of the channel cross section Sa (area of the channel cross section Sn/area of the channel cross section Sa) is larger or smaller than 1, but the change in the area ratio is desirably a monotonous change as shown in FIG. 7. This is because an abrupt area change causes a great change in the flow, whichever of an increasing change and a decreasing change the area change is, and the occurrence of swirl and the local occurrence of high speed area cause a great loss.

Figure 8:
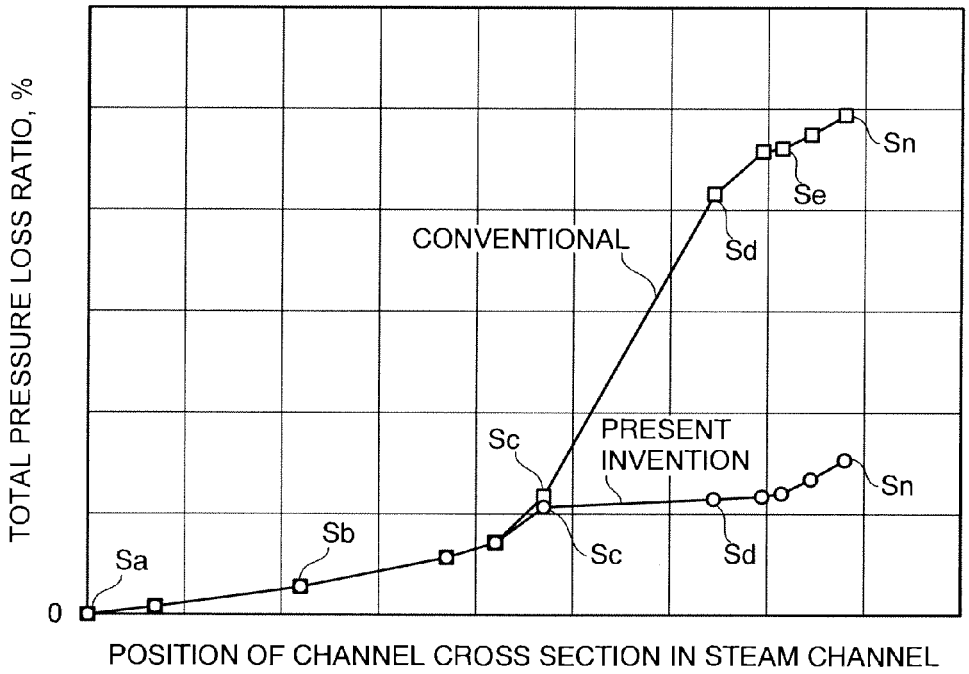
FIG. 8 is a graph showing total pressure loss ratios in the channel cross sections shown in FIG. 7.
Figure 9:
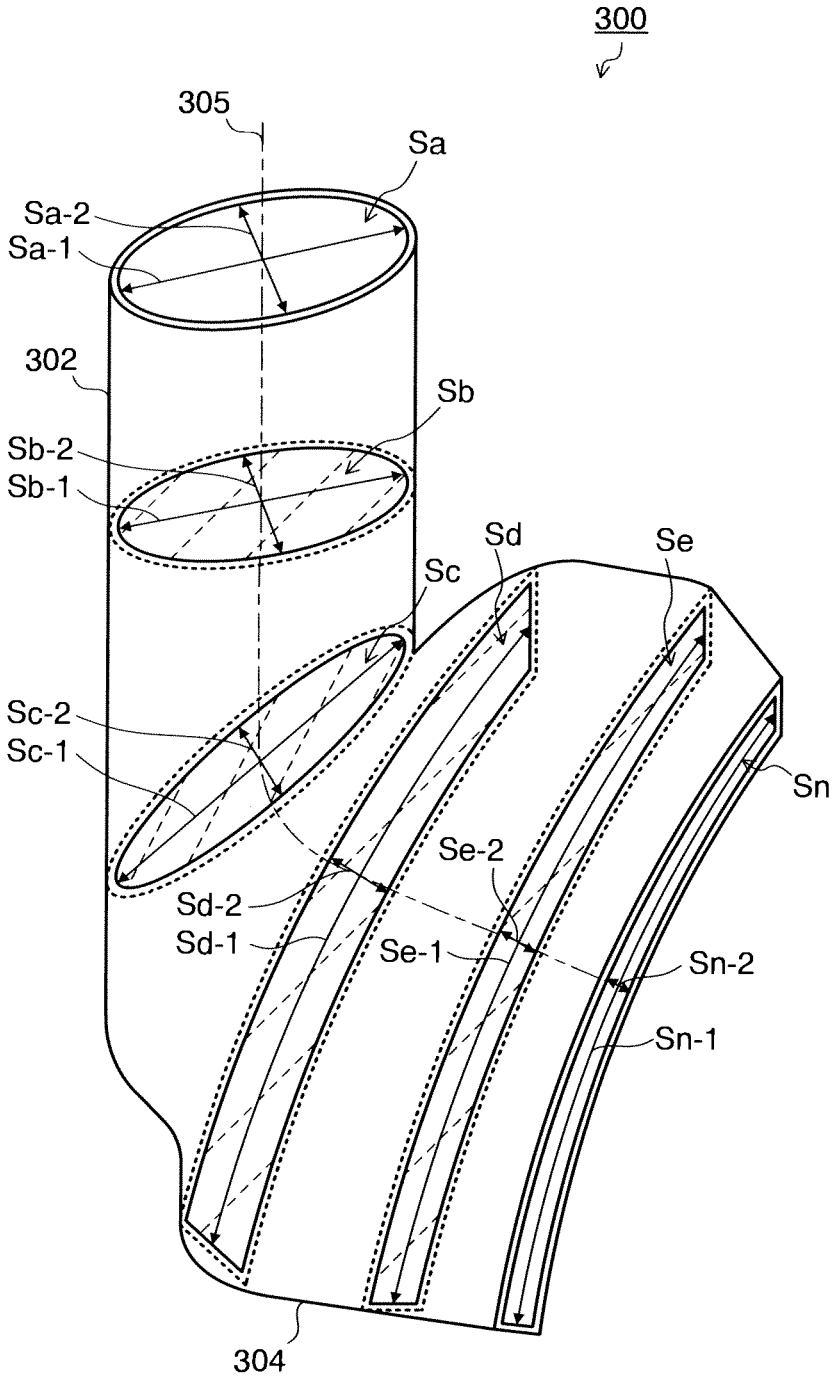
FIG. 9 is a perspective view showing part of a conventional nozzle box.
Figure 10:
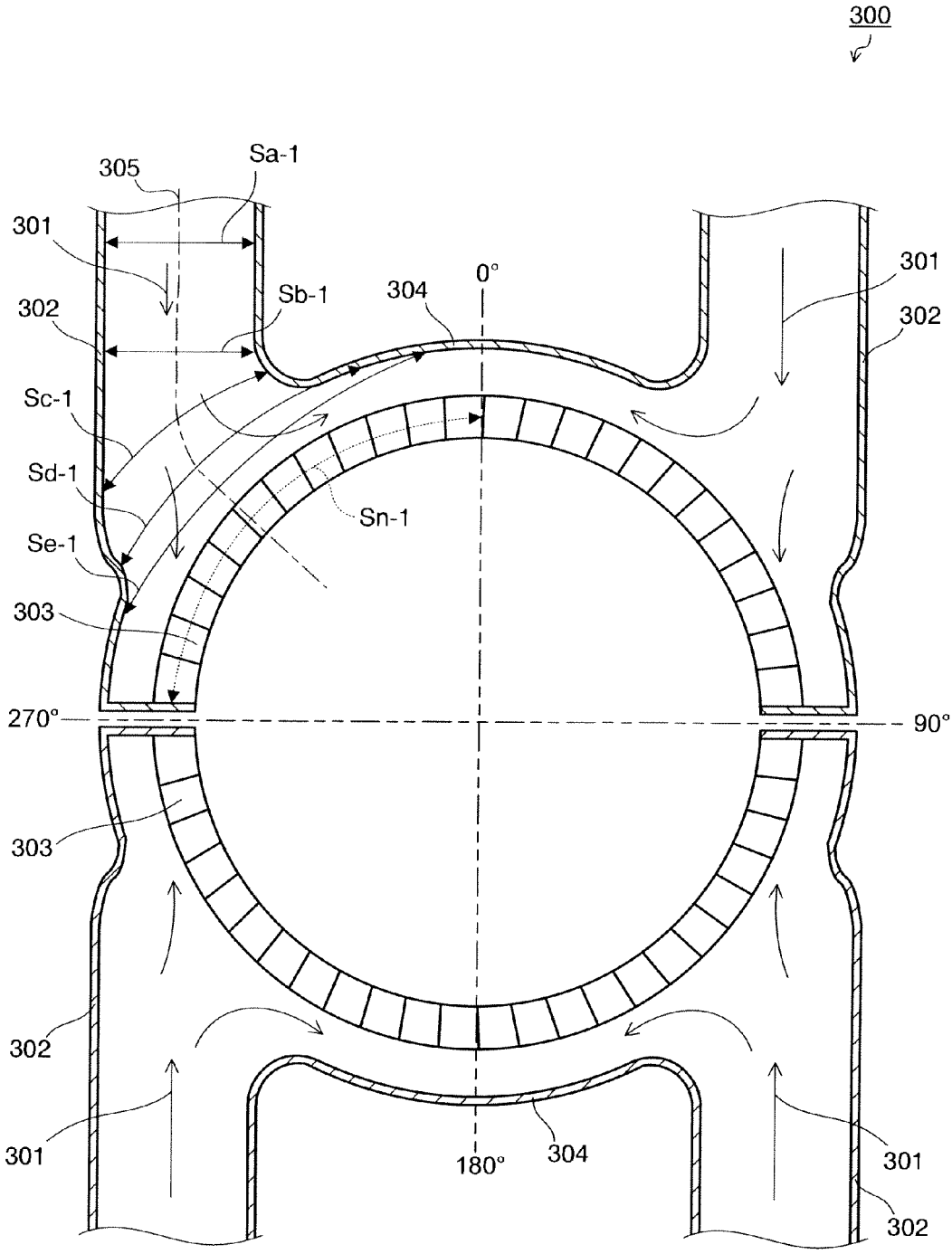
FIG. 10 is a view showing the conventional nozzle box in its cross vertical to a turbine rotor seen from a first-stage nozzle side.
Figure 11:
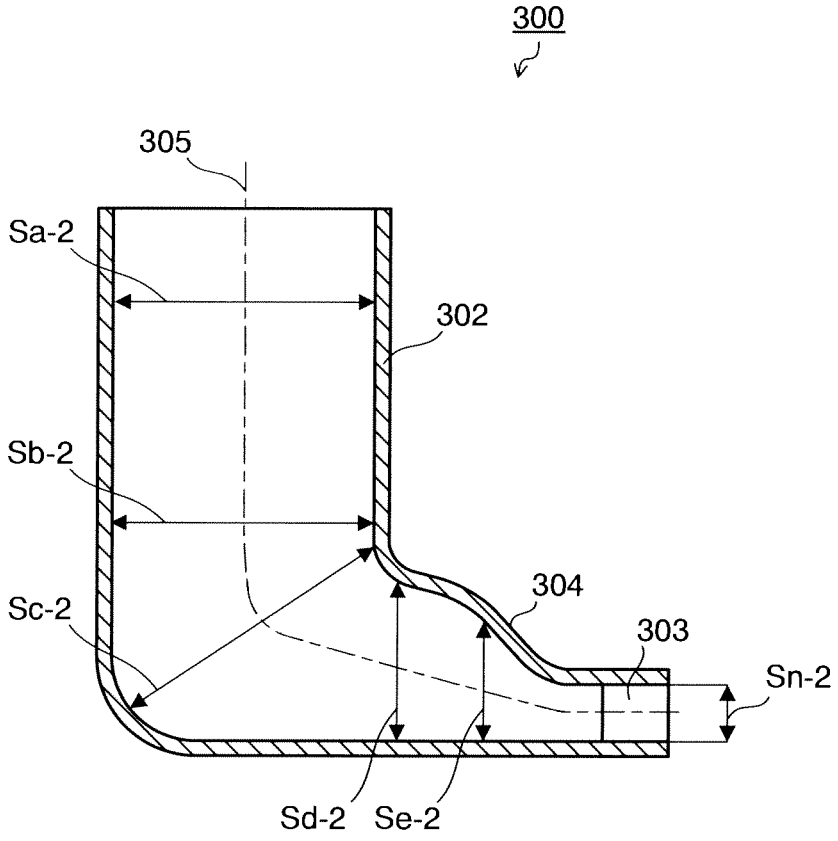
FIG. 11 is a view showing a cross section of the conventional nozzle box taken along a channel center line.
Figure 13:
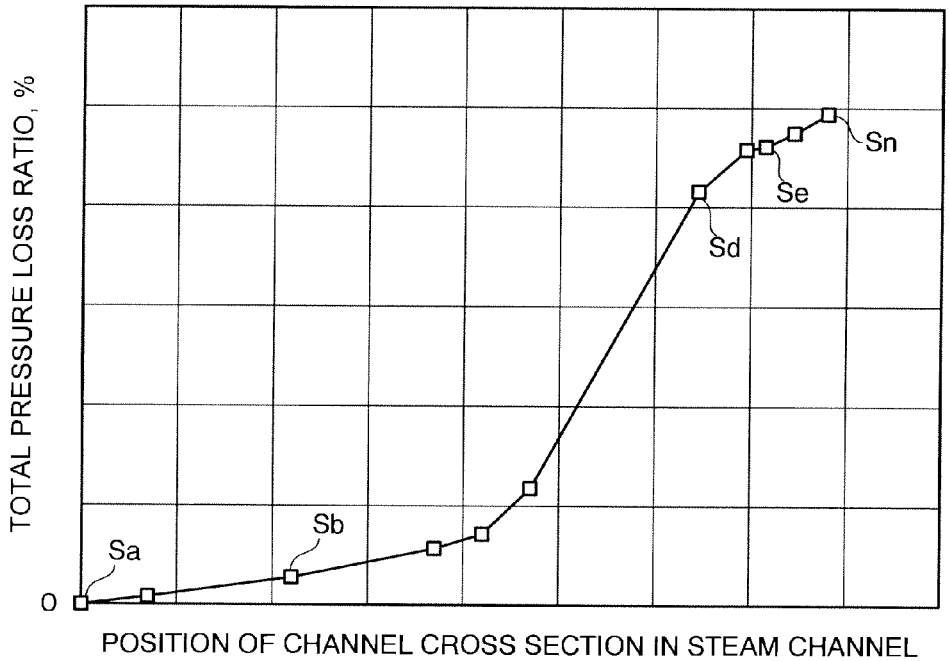
FIG. 13 is a graph showing total pressure loss ratios in the channel cross sections shown in FIG. 12.

FIG. 8 is a graph showing a total pressure loss ratio in each of the channel cross sections shown in FIG. 7. Note that FIG. 8 also shows, for comparison, total pressure loss ratios in the conventional nozzle box 300 shown in FIG. 13.

Here, the total pressure loss ratio is expressed by the aforesaid expression (1), where Pa is a total pressure at the inlet of the steam channel formed by the nozzle box 10, that is, in the channel cross section Sa at the inlet of the lead-in pipe 20, and Po is a total pressure in a given channel cross section. The total pressure loss ratios are obtained by three-dimensional thermal-fluid analysis in a steady state by using a CFD (Computational Fluid Dynamics).

As shown in FIG. 8, near the channel cross section Sc and the channel cross section Sn, the total pressure loss ratio in the nozzle box 10 of the embodiment increases, but is lower than ⅓ of the total pressure loss ratios in the conventional nozzle box 300.

As described above, in the nozzle box 10 of the embodiment according to the present invention, from the inlet of the lead-in pipe 20 toward the outlet of the annular pipe 40, the steam channel widths Sa-1 to Sn-1 in the first direction intersecting with the channel center line 50 are gradually increased, and the steam channel widths Sa-2 to Sn-2 in the second direction which intersects with the channel center line 50 and is perpendicular to the first direction are gradually decreased. Accordingly, the change in the channel cross section from the inlet of the lead-in pipe 20 toward the outlet of the annular pipe 40 is monotonous. Consequently, there is no great change in the cross sectional area in the channel cross sections from the inlet of the lead-in pipe 20 toward the outlet of the annular pipe 40, which can prevent an abrupt increase in the total pressure loss ratio. Therefore, in the steam turbine 200 including the nozzle box 10 of the embodiment according to the present invention, the total pressure loss in the steam channel leading the steam to the first-stage nozzle 213*a* is reduced, which can improve turbine efficiency.

The example is shown where, in the nozzle box 10 of the embodiment described above, two pairs of the pipes, each of the pairs being composed of the lead-in pipe 20 and the bent pipe 30, are provided for each of the two upper and lower parts into which the annular pipe 40 is divided, but this structure is not restrictive. For example, for each of the two upper and lower parts to which the annular pipe 40 is divided, one pair of the pipes or three or more pairs of the pipes, each of the pairs being composed of the lead-in pipe 20 and the bent pipe 30, may be provided. When the nozzle box 10 is thus structured, it is also possible to obtain the same operation and effect as those of the above-described nozzle box 10 of the embodiment.

In the foregoing, the present invention is concretely described by the embodiment, but the present invention is not limited only to the embodiment and the embodiment can be variously modified within a range not departing from the spirit of the invention. For example, the nozzle box 10 of the embodiment is applicable to an inlet part structure of each of a high-pressure part, an intermediate-pressure part, and a low-pressure part of the steam turbine.

What is claimed is:

1. A nozzle box of an axial flow turbine, comprising:

a lead-in pipe configured to lead a working fluid in a first channel direction;

a bent pipe connected to the lead-in pipe and formed so as to change a direction of a channel center line from the first channel direction to a second channel direction, the second channel direction being an axial direction of a turbine rotor of the axial flow turbine and different from the first direction; and an annular pipe connected to the bent pipe, covering the turbine rotor from an outer peripheral side of the turbine rotor, and forming an annular passage leading the working fluid to a first-stage nozzle of the axial flow turbine while spreading the working fluid in a circumferential direction of the turbine rotor, wherein the lead-in pipe, the bent pipe, and the annular pipe form a working fluid channel from an inlet of the lead-in pipe toward an outlet of the annular pipe, the working fluid channel having a gradually increasing channel width in a first direction intersecting with the channel center line and a gradually decreasing channel width in a second direction intersecting with the channel center line and perpendicular to the first direction.

2. The nozzle box of the axial flow turbine according to claim 1, wherein the channel width in the first direction and the channel width in the second direction exist on the same channel cross section perpendicularly intersecting with the channel center line of the working fluid channel, and when the channel width in the first direction and the channel width in the second direction are different from each other, the channel width in the first direction is a channel width in a longitudinal direction of the channel cross section.

3. The nozzle box of the axial flow turbine according to claim 2, wherein an area of the channel cross section monotonously changes from the inlet of the lead-in pipe toward the outlet of the annular pipe.

4. The nozzle box of the axial flow turbine according to claim 3, wherein the monotonous change is a monotonous decrease.

5. The nozzle box of the axial flow turbine according to claim 1, wherein at least one pair of pipes composed of the lead-in pipe and the bent pipe is provided for one annular pipe.

6. An axial flow turbine in which a led-in working fluid is led to a first-stage nozzle via a working fluid channel, wherein the working fluid channel is composed of the nozzle box of the axial flow turbine according to claim 1.

7. The nozzle box of the axial flow turbine according to claim 1, wherein the first channel direction is perpendicular to the second channel direction.

8. The nozzle box of the axial flow turbine according to claim 1, wherein the working fluid channel forms:

an upper working fluid channel configured to lead the working fluid to an upper half portion of the first-stage nozzle; and a lower working fluid channel configured to lead the working fluid to a lower half portion of the first-stage nozzle.

* * * * *